US008899333B2

(12) United States Patent
Guo et al.

(10) Patent No.: US 8,899,333 B2
(45) Date of Patent: Dec. 2, 2014

(54) SUBMARINE DEVICE

(75) Inventors: Yongfeng Guo, Hebei Province (CN); Shaojun Ji, Heibei Province (CN); Changquan Tang, Heibei Province (CN)

(73) Assignees: China National Offshore Oil Corporation, Beijing (CN); China Oilfield Services Limited, Sanhe, Hebei (CN)

( * ) Notice: Subject to any disclaimer, the term of this patent is extended or adjusted under 35 U.S.C. 154(b) by 625 days.

(21) Appl. No.: 12/745,843

(22) PCT Filed: Jun. 10, 2008

(86) PCT No.: PCT/CN2008/071248

§ 371 (c)(1),
(2), (4) Date: Jun. 2, 2010

(87) PCT Pub. No.: WO2009/082888

PCT Pub. Date: Jul. 9, 2009

(65) Prior Publication Data

US 2010/0243262 A1 Sep. 30, 2010

(30) Foreign Application Priority Data

Dec. 27, 2007 (CN) ..... 2007 1 0304438

(51) Int. Cl.

| | |
|---|---|
| ***E21B 41/04*** | (2006.01) |
| ***E21B 33/064*** | (2006.01) |
| ***E21B 17/01*** | (2006.01) |
| ***E21B 43/013*** | (2006.01) |

(52) U.S. Cl.

CPC ..... *E21B 33/064* (2013.01); *E21B 17/012* (2013.01); *E21B 43/013* (2013.01)

USPC ..... 166/345; 166/350; 166/352; 166/355; 166/367

(58) Field of Classification Search

USPC ..... 166/345, 350, 352, 355, 367; 441/133

See application file for complete search history.

(56) References Cited

U.S. PATENT DOCUMENTS

| | | | | |
|---|---|---|---|---|
| 4,099,560 | A * | 7/1978 | Fischer et al. | 166/350 |
| 4,448,266 | A | 5/1984 | Potts | |

(Continued)

FOREIGN PATENT DOCUMENTS

| | | | |
|---|---|---|---|
| CN | 101109269 | A | 1/2008 |
| CN | 101109277 | A | 1/2008 |

(Continued)

*Primary Examiner* — James G Sayre

(74) *Attorney, Agent, or Firm* — Ling Wu; Stephen Yang; Ling and Yang Intellectual Property LLC

(57) ABSTRACT

The invention discloses a subsea device comprising a can, a string of risers, a blowout preventer and a string of tie-back pipes. The blowout preventer is installed on the can. The top of risers is connected to a rig and its bottom is mounted on the blowout preventer. The upper of tie-back pipes is fixed to the can. The lower of tie-back pipes is mounted to a wellhead in the seabed by a subsea wellhead apparatus and connected to the casings for collecting oil/gas stored in formations by the subsea wellhead apparatus. A passage communicating the blowout preventer with tie-back pipe is jointed on the can. A pipeline, transporting oil/gas, mud and cuttings in drilling process, is divided into two sections, both tie-back pipes and casings, by the wellhead apparatus settled on seabed, thereby ensuring security of the rig in the drilling process and stronger operability of entire production system.

8 Claims, 2 Drawing Sheets

(56) References Cited

U.S. PATENT DOCUMENTS

| | | | | |
|---|---|---|---|---|
| 4,616,707 | A | 10/1986 | Langner | |
| 4,934,871 | A | 6/1990 | Kazokas, Jr. | |
| 5,676,209 | A | 10/1997 | Reynolds | |
| 6,155,748 | A | 12/2000 | Allen et al. | |
| 6,210,075 | B1 | 4/2001 | Korloo | |
| 6,854,516 | B2 * | 2/2005 | Nish et al. | 166/350 |
| 7,008,141 | B2 | 3/2006 | Fitzgerald et al. | |
| 7,503,391 | B2 * | 3/2009 | McCanna et al. | 166/343 |
| 8,047,297 | B2 * | 11/2011 | Millheim et al. | 166/367 |
| 2006/0042800 | A1 * | 3/2006 | Millheim et al. | 166/344 |
| 2009/0095485 | A1 * | 4/2009 | Finn et al. | 166/350 |
| 2009/0126937 | A1 * | 5/2009 | Millheim | 166/350 |

FOREIGN PATENT DOCUMENTS

| | | | |
|---|---|---|---|
| CN | 101191408 | A | 4/2008 |
| CN | 201092825 | Y | 7/2008 |
| CN | 201092840 | Y | 7/2008 |
| CN | 101139912 | A | 12/2008 |
| EP | 1659257 | A1 | 5/2006 |

* cited by examiner

SUBMARINE DEVICE

TECHNICAL FIELD

The present invention relates to a subsea device for engineering of drilling in deepwater.

BACKGROUND ART

It has been a traditional technology to use the semi-submersible platform (or rig) to explore oil in the deepwater in the world; its development process is rather perfect. However, due to high cost of the semi-submersible platform (or rig) for the deepwater oil exploration, using such method would cause enormous cost for the deepwater oil exploration.

SUMMARY OF THE INVENTION

A technical problem to be solved by the present invention is to provide a subsea device capable of reducing greatly construction cost.

In order to solve the technical problem described above, the present invention provides a subsea device comprising a can, a string of risers, a blowout preventer and a tie-back pipe system. The blowout preventer is installed on the can. The top of risers is connected to a rig and its bottom is mounted on the blowout preventer. The upper of tie-back pipe system is fixed to the can. The lower of tie-back pipe system is mounted to a wellhead of a seabed by a subsea wellhead apparatus and connected to formation casings for collecting oil or natural gas stored in formations by the subsea wellhead apparatus. A passage which communicates the blowout preventer with the tie-back pipe system is jointed on the can.

Preferably, the tie-back pipe system comprises an outmost tie-back pipe, in which more than two casings are nested successively. The upper of tie-back pipe is fixed to the can and its lower is mounted to the wellhead of the seabed. The upper of casings is fixed to the can and its lower is mounted to the wellhead of the seabed. The innermost casing is communicated to the formation casings.

Preferably, the subsea device further comprises a buoyancy force adjustment device, by which the can regulates the magnitude of its buoyancy force.

Preferably, the buoyancy force adjustment device comprises a set of compressors mounted on the rig, an inject valve fixed on the can, and a cable connected between the set of compressors and the inject valve. The set of compressors transfer gas to the can through the cable and control incoming gas through the inject valve.

Preferably, a vent valve is provided on the can. The advantages of the present invention will be described bellow.

1. A pipeline, which transports oil and gas as well as drilling cuttings and mud in drilling process, is divided into two sections, i.e., both the tie-back pipe system and the formation casings, by the subsea wellhead apparatus settled on the seabed, thereby ensuring the security of the drilling platform or rig in the drilling process and the stronger operability of entire production system.

2. The upper of tie-back pipe system is fixed to a buoy and its lower is fixed to the subsea wellhead apparatus mounted on the seabed. The lower of tie-back pipe system is connected to the casings below the seabed, which transports oil and gas as well as drilling cuttings and mud in drilling process, by the subsea wellhead apparatus. Therefore, in actual drilling operation process, facilities of the tie-back pipe system may be added to make the operation process more compact. That is, it is possible to mount the tie-back pipe system after the formation casings are installed and fixed to the seabed using cement, such that the installation process is more unconstrained and secure.

3. The lower of tie-back pipe system is fixed on the seabed and its upper is fixed on the buoy. Thus, the can bears most of the weight of the tie-back pipe system and the buoyancy force adjustment device may regulate a levitation force of the hollow buoy such that the hollow buoy can better bear the weight of the tie-back pipe system in the sea, thereby reducing the load of the rig greatly.

4. Using the tie-back pipe system in accordance with the present invention makes it possible to connect the buoy with the wellhead of the oil (gas) well in the seabed. In addition, a number of casings inside the tie-back pipe system may improve the reliability and security of the tie-back pipe system transporting oil and gas and make it possible to perform drilling operation at water depth of 1500 m using a semi-submersible drilling platform operating at water depth of 500 m.

PREFERRED EMBODIMENTS OF THE INVENTION

Figure 1:
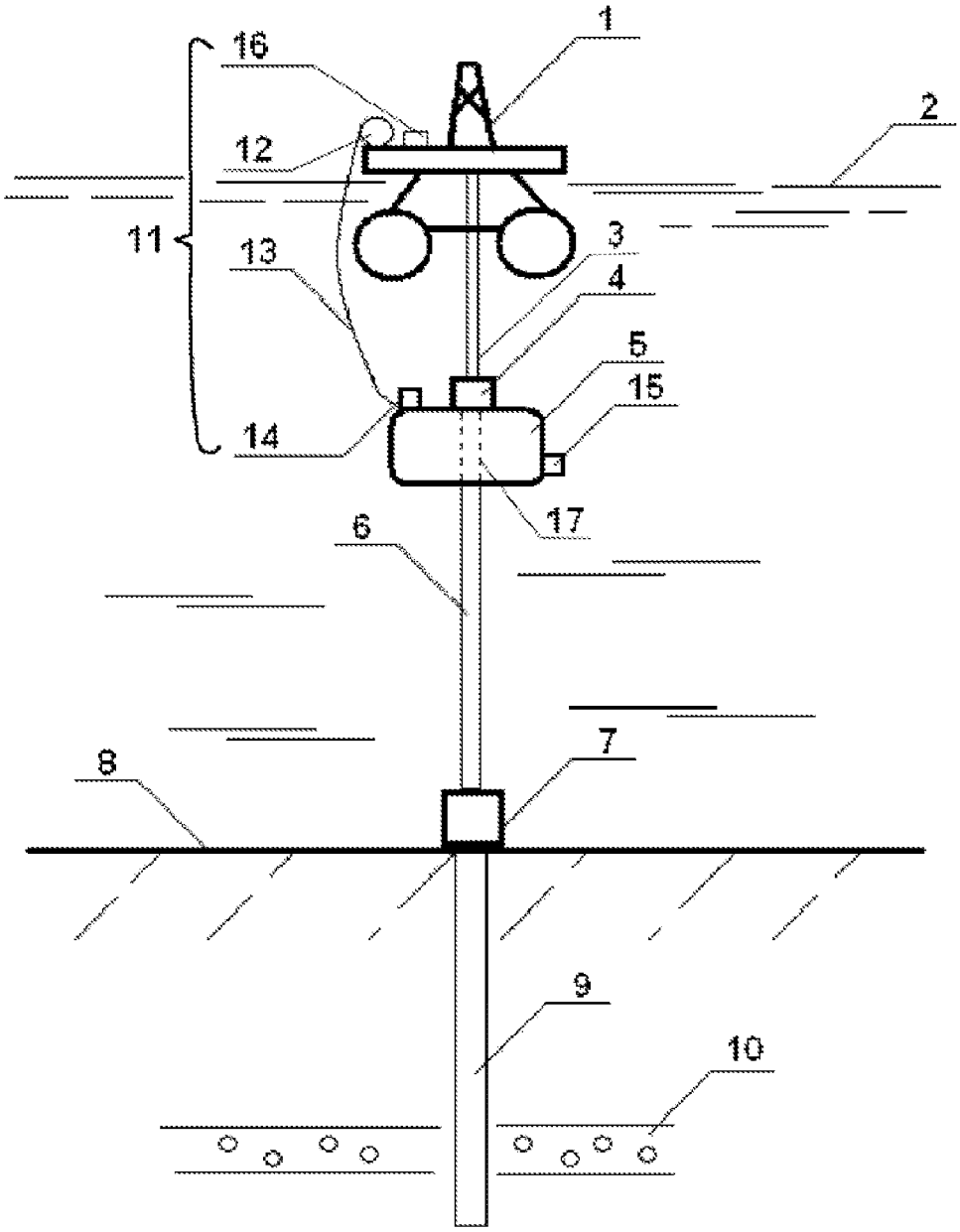
FIG. 1 is a structural diagram of a subsea device installed in the sea in accordance with the present invention.

As shown in FIG. 1, a subsea device in accordance with the present invention comprises a can 5, a string of risers 3, a blowout preventer 4 and a tie-back pipe system 6. The blowout preventer 4 is provided on the can 5, which may be one or a set of hollow tank bodies and may be suspended between a sea surface 2 and a seabed 8. The top of risers 3 is connected to a rig 1 (or semi-submersible drilling platform) and its bottom is mounted on the blowout preventer 4. The upper of tie-back pipe system 6 is fixed to the can 5. The lower of tie-back pipe system 6 is mounted to a wellhead of the seabed 8 by a subsea wellhead apparatus 7 and connected to formation casings 9 for collecting oil or natural gas 10 stored in formations by the subsea wellhead apparatus 7. A passage 17 which communicates the blowout preventer 4 with the tie-back pipe system 6 is jointed on the can 5. Oil or natural gas 10 is collected and then transported by the formation casings 9 to the tie-back pipe system 6, which in turn further transports the oil or natural gas 10 to the rig 1 on the sea surface 2 by the risers 3 so as to accomplish the entire exploitation of oil and gas. The blowout preventer 4 is installed such that as a drill bit encounters high pressure oil and gas in the formations, the blowout preventer 4 in a position above the seabed 8 may be closed quickly in the drilling process so as to cut off a borehole, through which the high pressure oil and gas in the formations pass, and a passage, through which the high pressure oil and gas in the formations spray upwardly out of the wellhead to guarantee the security of equipments and workers in the drilling operation.

In order to reduce the load of the rig 1 and better bear the weight of the tie-back pipe system 6 in the sea, the present invention also designs a buoyancy force adjustment device 11, by which the can 5 may regulate the magnitude of its buoyancy force. As shown in FIG. 1, the buoyancy force adjustment device 11 comprises a set of compressors 16 mounted on the rig 1, an inject valve 14 fixed on the can 5, a cable 13 connected between the set of compressors 16 and the inject valve 14, and a cable control winch 12 mounted also on the rig 1. The set of compressors 16 transfer gas to the can 5 through the cable 13 and control incoming gas through the inject valve 14. The cable control winch 12 is used for controlling the length of the cable 13. A vent valve 15 is also provided on the can 5. When a buoyancy force is required to be increased, the set of compressors 16 and the inject valve 14 are opened to transport the gas, which may be air or nitrogen gas, etc., to the can 5. When the buoyancy force is required to be decreased, the vent valve 15 is opened so as to reduce the buoyancy force.

In general, the design length of the tie-back pipe system is about more than 1000 m, and it is impossible to bear its weight by the seabed. The buoyancy force of the can 5 may be used to support the weight of the tie-back pipe system 6 under it. Meanwhile, the subsea wellhead apparatus 7 fixed on the seabed 8 may in turn fix the can 5 in a proper position in the sea by the tie-back pipe system 6. The subsea wellhead apparatus 7 is fixed by a huge cementation force generated by cement consolidation of the formation casings 9 under the subsea wellhead apparatus 7 and rock under the seabed 8 so as to maintain both the fixture of the subsea wellhead apparatus 7 and the relative fixture of the can 5 in the sea. The role of the subsea wellhead apparatus 7 is to connect the casings 9 at its lower end with the tie-back pipe system 6 located in the sea at its upper end.

The present invention utilizes the buoyancy force of the can 5 in the sea to bear the weight of the tie-back pipe system 6 in deepwater oil exploration operation so as to reduce the load of the rig 1 (or semi-submersible platform) greatly, thereby decreasing construction cost of the rig 1 (or semi-submersible platform) and decreasing eventually cost and expense of the deepwater oil exploration.

Figure 2:
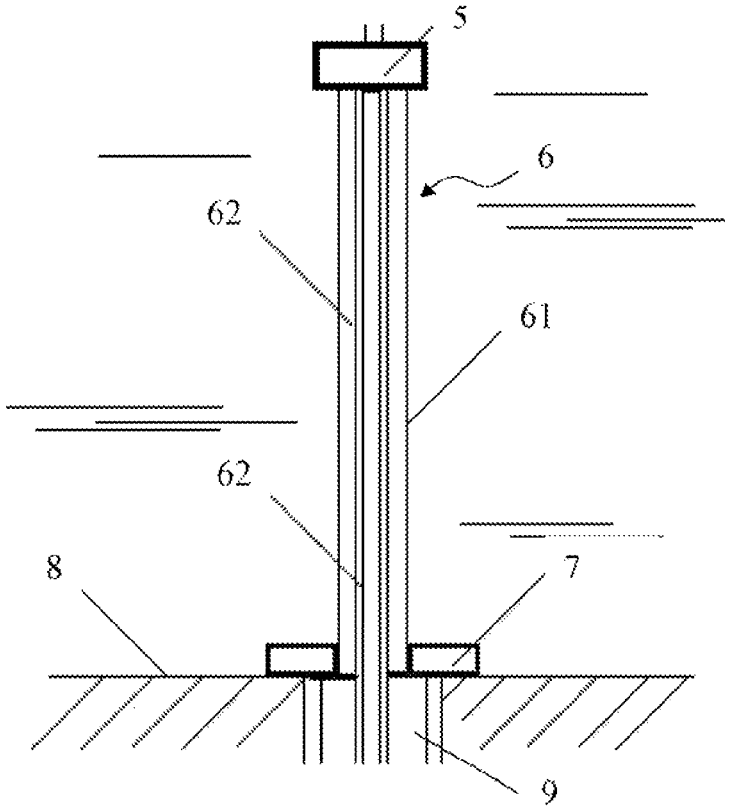
FIG. 2 is a cross-sectional view of a tie-back pipe system.

The tie-back pipe system 6 may be a single tie-back pipe or a composite structure tube as shown in FIG. 2. Specifically, the tie-back pipe system 6 includes an outmost tie-back pipe 61, in which two casings 62 are nested successively. The upper of tie-back pipe 61 is fixed to the can 5 and its lower is mounted to the wellhead of the seabed 8. One of roles of the tie-back pipe 61 is to support and centralize the casings 62, and the other role is to install first the tie-back pipe 61 and then the casings 62 at the beginning of installation of lower tubes for the sake of waterproof and separation of mud. The upper of casings 62 are fixed to the can 5 and its lower is mounted to the wellhead of the seabed 8. The innermost casing of the casings 62 is communicated to the formation casings 9 to transport high pressure oil and gas collected in the stratum, and mud is transported between the innermost casing and the second casing. If the casings 62 include more than three casings, then the casings 62 from the third casing to the outmost casing, along with the tie-back pipe 61, are used for support and centralization.

In view of the above, what is described above is only a preferable embodiment of the present invention and is not intended to limit the protection scope of the present invention. Therefore, any modification, equivalent replacement and improvement made within the spirit and principle of the present invention should be included in the protection scope of the present invention.

What we claim is:

1. A subsea device used for semi-submersible rig, comprising a buoyancy force adjustable can, a string of risers, a blowout preventer, a string of tie-back pipes, an inject valve fixed on the top of the can, a vent valve fixed on a side of the can, and a buoyancy force adjustment device connected to the inject valve;

the blowout preventer being directly installed on the top of the can, the top of the string of risers being connected to the rig and the bottom of the string of risers being mounted on the blowout preventer;

the top of the string of tie-back pipes being fixed to the bottom of the can, the lower end of the string of tie-back pipes being mounted to a wellhead on the seabed through a subsea wellhead apparatus fixed on the seabed and being connected to a formation casing for collecting oil or natural gas stored in formations;

and a passage being located in the can to communicate with the blowout preventer and the string of tie-back pipes;

wherein the buoyancy force of the can is adjusted with the buoyancy force adjustment device, the inject valve and the vent valve to bear most of the weight of the string of tie-back pipes.

2. The subsea device according to claim 1, wherein the buoyancy force adjustment device comprises a set of compressors mounted on the rig, a cable control winch, and a cable connected with the set of compressors and the inject valve; wherein the set of compressors is configured to transfer gas to the can through the cable and the inject valve, and the cable control winch is configured to adjust the length of the cable to locate the can a pre-determined position in the sea.

3. The subsea device according to claim 2, wherein the vent valve is fixed near the bottom of the can.

4. A subsea device used for semi-submersible rig, comprising a buoyancy force adjustable can, a string of risers, a blowout preventer and a tie-back pipe system;

the blowout preventer being directly installed on the top of the can, the top of the string of risers being connected to the rig and the bottom of the string of risers being mounted on the blowout preventer;

the top of the tie-back pipe system being fixed to bottom of the can, the lower end of the tie-back pipe system being mounted to a wellhead on the seabed through a subsea wellhead apparatus fixed on the seabed and being connected to a formation casing for collecting oil or natural gas stored in formations; and a passage being located in the can to communicate with the blowout preventer and the tie-back pipe system;

wherein the tie-back pipe system comprises a tie-back pipe at the outmost of the tie-back pipe system and more than two casings nested successively inside the tie-back pipe, the tops of the tie-back pipe and said more than two casings are fixed to the bottom of the can, the lower end of the tie-back pipe is mounted to the wellhead on the seabed, and the lower ends of said more than two casings are mounted to the wellhead on the seabed and connected with the formation casing inside the wellhead.

5. The subsea device according to claim 4, further comprising an inject valve, which is fixed on the top of the can;

a vent valve, which is fixed on a side of the can;

a buoyancy force adjustment device, which is connected with the inject valve;

wherein the buoyancy force of the can is adjusted with the buoyancy force adjustment device, the inject valve and the vent valve to bear most of the weight of the tie-back pipe system.

6. The subsea device according to claim 5, wherein the buoyancy force adjustment device comprises a set of compressors mounted on the rig, a cable control winch, and a cable connected with the set of compressors and the inject valve; wherein the set of compressors is configured to transfer gas to the can through the cable and the inject valve, and the cable control winch is configured to adjust the length of the cable to locate the can a pre-determined position in the sea.

7. The subsea device according to claim 6, wherein the vent valve is fixed near the bottom of the can.

8. The subsea device according to claim 6, wherein the tie-back pipe is configured to support and centralize said more than two casings.

* * * * *